US008647243B2

(12) United States Patent
Januszek

(10) Patent No.: US 8,647,243 B2
(45) Date of Patent: Feb. 11, 2014

(54) EXERCISE DEVICE WEIGHT FOR MOUNTING TO A LIFTING BAR

(75) Inventor: Richard Zdzislaw Januszek, Peterborough (GB)

(73) Assignee: Escape Fitness Ltd., Peterborough (GB)

( * ) Notice: Subject to any disclaimer, the term of this patent is extended or adjusted under 35 U.S.C. 154(b) by 0 days.

(21) Appl. No.: 12/832,437

(22) Filed: Jul. 8, 2010

(65) Prior Publication Data

US 2011/0009247 A1 Jan. 13, 2011

(30) Foreign Application Priority Data

Jul. 8, 2009 (GB) ..... 0911848.0

(51) Int. Cl.
*A63B 21/072* (2006.01)
*A63B 21/075* (2006.01)

(52) U.S. Cl.
USPC ..... 482/108; 482/106

(58) Field of Classification Search
USPC ..... 482/44, 49–50, 92, 106–108, 139; D21/662, 680–682
See application file for complete search history.

(56) References Cited

U.S. PATENT DOCUMENTS 4,361,324 A 11/1982 Baroi
4,913,422 A 4/1990 Elmore et al.
5,242,350 A * 9/1993 Chang ..... 482/108
5,250,014 A 10/1993 Chang
7,527,582 B2 * 5/2009 Januszek ..... 482/108
2002/0098956 A1 * 7/2002 Rattray ..... 482/108
2008/0070762 A1 * 3/2008 White ..... 482/108
2010/0298100 A1 * 11/2010 McVan ..... 482/45

FOREIGN PATENT DOCUMENTS

CN 2167738 Y 6/1994
CN 29363 Y 8/2007
CN 2936320 Y 8/2007
KR 200437442 Y1 11/2007

* cited by examiner

*Primary Examiner* — Oren Ginsberg
(74) *Attorney, Agent, or Firm* — Endurance Law Group, PLC

(57) ABSTRACT

An exercise device weight section (2) for mounting to a lifting bar (4) of an exercise device (1), in particular a dumbbell or barbell. The weight section (2) having an outer circumferential surface (15) comprising an outer skin (14) at least partially around the outer circumferential surface of the weight section (2) comprising a plurality of resilient projections (16) extending from at least part of the outer circumferential surface of the weight section (2). The plurality of projections (16) are disposed only in a discrete circumferential region (29) of the circumferential surface of the weight section (2). The projections (16) provide improved impact absorption when the weight section (2) is dropped protecting the weight section, floor and associated equipment form damage, and also reduce loosening of the mounting of the weight section on the bar (4). The projections (16) also provide areas of improved grip allowing the weight section and exercise device to be better gripped and lifted. Recesses (40) may also be defined in the weight sections to further define handles for gripping the weight section (2).

16 Claims, 5 Drawing Sheets

EXERCISE DEVICE WEIGHT FOR MOUNTING TO A LIFTING BAR

BACKGROUND OF THE INVENTION

1. Field of the Invention

The present invention relates to an exercise device and in particular to a dumbbell or barbell for weight lifting and other fitness activities. More specifically it relates to the weight sections for mounting to a lifting bar in such exercise devices.

2. Related Art

Conventional dumbbells or barbells comprise a bar and a set of weights mounted on the ends of the bar. The dumbbell or barbell is lifted by the handle bar in order to train specific muscles groups, and/or increase muscle mass. The weights may be permanently fixed, for example in a dumbbell, or may be removably mounted so as to alter the weight in a barbell type arrangement but also in some dumbbell arrangements.

An increase in the popularity of fitness training has resulted in the development of many new training programs and classes, to cater for a broad spectrum of training requirements. As such, increasingly varied weight training equipment is required to satisfy new training programs and techniques.

It is increasingly common for training programs and classes to require participants to perform weight lifting operations which differ from the conventional weight lifting techniques for which dumbbells were originally designed. However, space and cost restrictions limit the number of different types of training equipment which a gym or fitness club may purchase and store. Therefore, there is a need for weightlifting equipment which can be used in a variety of ways, to perform a number of different weightlifting operations.

A further problem associated with conventional dumbbells or barbells arises when they are dropped to the floor after use. The impact of the weight heads on the ground, particularly if the weight heads do not impact the ground simultaneously, causes a loosening of the fixing means (either permanent or removable) used to secure the weight heads to the handle. Over time, repeated dropping can lead to the weight heads becoming noticeably loose, or even falling off the handle, resulting in a risk of injury to the user. The increase in the number of gym members, and therefore the increasing frequency with which such weights are used, significantly accelerates this process, which greatly reduces the life cycle of the dumbbells, and can lead to damage of the associated equipment such as racks and benches, and can cause unnecessary wear to the flooring.

U.S. Pat. No. 4,361,324, and Chinese utility model applications CN2167738 and CN 20062045127 disclose dumbbells with rubber outer covers with tread patterns extending circumferentially around the entire circumference of the weight sections. The tread and rubber cover provides some cushioning and in the case of CN 2167738 are described as providing some anti-sliding function. U.S. Pat. No. 5,250,014 also describes a dumbbell with a cushioning plate with as series of projections extending around the entire circumference of the dumbbell. These arrangements can however be improved both in terms of aesthetics, and in providing improved functionality in terms of use by a user and improved cushions and grip, as well as more generally.

There is therefore also a need for an improved dumbbell or bar bell which is able to better withstand frequent use, and in particular withstand repeated impact from dropping, and reduces the likelihood of damage to other equipment, as well as which can be used in a wider range of exercises.

SUMMARY OF THE INVENTION

The present invention aims to provide a dumbbell which obviates or mitigates the above described problems and/or which provides improvements generally or an alternative to such existing arrangements.

According to the present invention, there is therefore provided an exercise device weight section, and an exercise device including such an exercise device weight section, as defined in the accompanying claims.

In an embodiment of the invention there is provided an exercise device weight section for mounting to a lifting bar of an exercise device, in particular a dumbbell or barbell. The weight section has an outer circumferential surface and comprises an outer skin at least partially around the outer circumferential surface of the weight section. The outer skin furthermore comprises a plurality of resilient projections extending from at least part of the outer circumferential surface of the weight section. The plurality of projections are disposed only in discrete circumferential regions of the circumferential surface of the weight section. The plurality of projections are preferably disposed in a pair of diametrically opposing discrete circumferential regions of the circumferential surface of the weight section.

Preferably the projections define a relief pattern formed in the surface of the outer skin. The relief pattern may be configured to optimize impact absorption and/or grip properties. Preferable the relief pattern may comprise a random geometric pattern, or tread pattern similar in form and function to tread patterns used on vehicle tires.

The resilient projections improve the impact absorption properties of the outer skin and hence of the weight section and exercise device. Specifically, compression of the projections during impact of the weight section with the ground acts to absorb the impact energy and increase deceleration time during impact, thereby providing a "softer" impact. This softer impact reduces jarring of the weight section, and of the fixings between the weight section and the handle of the exercise device to which the weight section is mounted, thereby mitigating the risk of loosening of the weight heads, mitigating damage to the weight section, and reducing damage to the exercise device, for example dumbbell generally, and to other equipment.

The resilient projections also provide the weight sections with increased surface grip. This enables the weight section and for example dumbbell to be safely and securely gripped by the weight sections, rather than the handle, and so be used for a variety of different weight lifting operations. Similarly the projections provide increased traction to prevent the dumbbells from slipping against the ground when a user places their weight on them, for example to perform push ups.

Providing projections and a pattern only in a discrete circumferential region of the circumference of the weight section better defines a particular grip region for a user to grip and hold the weight section and dumbbell for certain exercises. In addition it also varies the level of grip and cushioning provided circumferentially around the weight section which again can be advantageous for different exercises. Furthermore it also varies the outer circumference surface of the dumbbell circumferential around the dumbbell such that the dumbbell will tend to rest in a particular circumferential position when placed on the ground. This assists in preventing the dumbbell from rolling when placed on the ground.

The exercise device weight section preferably further comprises at least one recess, and preferably a pair of recesses disposed circumferentially diametrically opposite each other, defined in the outer circumferential surface of the weight section. The recesses are most preferably aligned with the discrete circumferential region of the circumferential surface of the weight section where projections disposed. The recess is preferably defined towards one axial end of the weight section.

The recesses and/or region of projections are thereby configured to form a grip portion for a user to grip and hold the weight section. The recess in particular further define a grip portion for holding the weight section, especially when part of a dumbbell, with a user's fingers being able to fit into the recesses. This improves a user's grip of the weight section, as well as more clearly indicating where and how a user can hold the weight section and dumbbell. The recesses forming a grip are a particularly important feature and aspect of the invention and may be used separately.

The recesses are preferably formed in and as part of outer skin. This allows the recess to be most easily formed with a simple cast inner weight section, core which does not include such a recess. In addition it provides a relatively flexible and soft shoulder area surrounding the recess improving grip and comfort to a user.

In addition to providing improved grip and/or impact absorption properties, the relief pattern formed by the raised surface features may be configured to provide the exercise device with a unique fingerprint. The relief pattern may configured to be specific to a single weight section, or range of weight sections, enabling the consumer to identify the weight sections as deriving from a particular manufacturer or retailer. The unique fingerprint relief pattern may be formed in the surface of the molds used to form the outer skin. Forming the unique fingerprints in the surface of the molds prevents unauthorized use of the molds to produce products from third parties, as any weight sections produced from the molds will be easily identifiable from the unique fingerprint.

The projections may be defined by a plurality of grooves which are formed in the surface of the outer skin. The upper surface of the projections define a raised portion of the skin having a first thickness, and the lower surface of the grooves define a recessed portion having a second thickness less than the first thickness.

The outer skin may be formed from polyurethane or rubber or similar resilient compressible materials. The resilient projections may be integrally formed with and from the outer skin. Integrally forming the projections from the outer skin enables the projections to be formed in the same manufacturing step as the skin, thereby simplifying manufacture. In addition, the integral projections are thus securely connected to the outer skin, as compared for example to the use of an adhesive to secure the projections as separate elements.

The weight section may comprise an inner weight section comprising a cast metal weight.

The outer skin may be molded about the inner weight section, and the plurality of shock absorbing projections are integrally molded with the outer skin. Alternatively, the plurality of shock absorbing projections may be formed, for example cut or branded, onto the outer skin after the outer skin has been molded to the inner weight section.

The outer skin and resilient projections may be formed from polyurethane or rubber.

A particular embodiment of the invention comprises an exercise device comprising a lifting bar, and at least one exercise device weight section mounted on the lifting bar. The exercise device weight comprises an outer skin at least partially around an outer circumferential surface of the weight section. The outer skin furthermore comprises a plurality of resilient projections extending from at least part of the outer circumferential surface of the weight section.

Preferably the lifting bar has an end portion and the at least one exercise device weight section is mounted on the end portion of the lifting bar. In particular the lifting bar may have two opposing end portions, and exercise device weight sections are mounted to each of the opposing end portions of the bar.

Each weight section has a sloped tapering axial end face. The weight sections are mounted on the bar such that the sloped tapering axial end faces of the weight sections face each other. This provides improved comfort holding the device.

The exercise device is preferably a dumbbell or barbell.

In a further aspect of an embodiment of the invention there is provided a method of manufacturing an exercise device weight section. The method comprises providing at least one inner weight section that it is mountable to a lifting bar of an exercise device, and that has a circumferential outer surface, and forming an outer skin at least partially around the outer circumferential surface of the inner weight section. The step of forming the outer skin comprises forming the outer skin with a plurality of resilient projections extending from at least a part of an outer circumferential surface of the weight section. The plurality of projections are formed only in discrete circumferential regions of the circumferential surface of the weight section.

The step of forming the outer skin with a plurality of resilient projections may comprise forming the outer skin and then subsequently forming the plurality of resilient projections in an outer circumferential surface of the outer skin. The forming of the plurality of resilient projections in the outer circumferential surface of the outer skin may then comprise cutting or branding grooves or recess into the outer skin to define the plurality of projections in the outer skin.

More preferably however the step of forming the outer skin comprises molding the outer skin about the circumferential outer surface of the inner weight section. The step of molding the outer skin may include molding the plurality of projections such that the outer skin and the projections are integrally formed with the outer skin. The method may accordingly further comprise providing a mold having an inner mold surface corresponding to the outer circumferential surface of the weight section and plurality of projections thereon; placing the at least one inner weight section in the mold such that a mold cavity is defined at least between the outer circumferential of the inner weight section and the inner mold surface; and injecting a material into the mold cavity to form the outer skin about the at least one weight section and plurality of projections extending therefrom.

The mold preferably comprises at least two mold sections, or mold halves which are separable to allow the weight section to be placed within and removed there from. This two part mold arrangement enables the weight section to be easily removed from the mold after molding by separating the two mold sections, which would not be possible with a one piece mold due to the projections extending into the mold walls.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
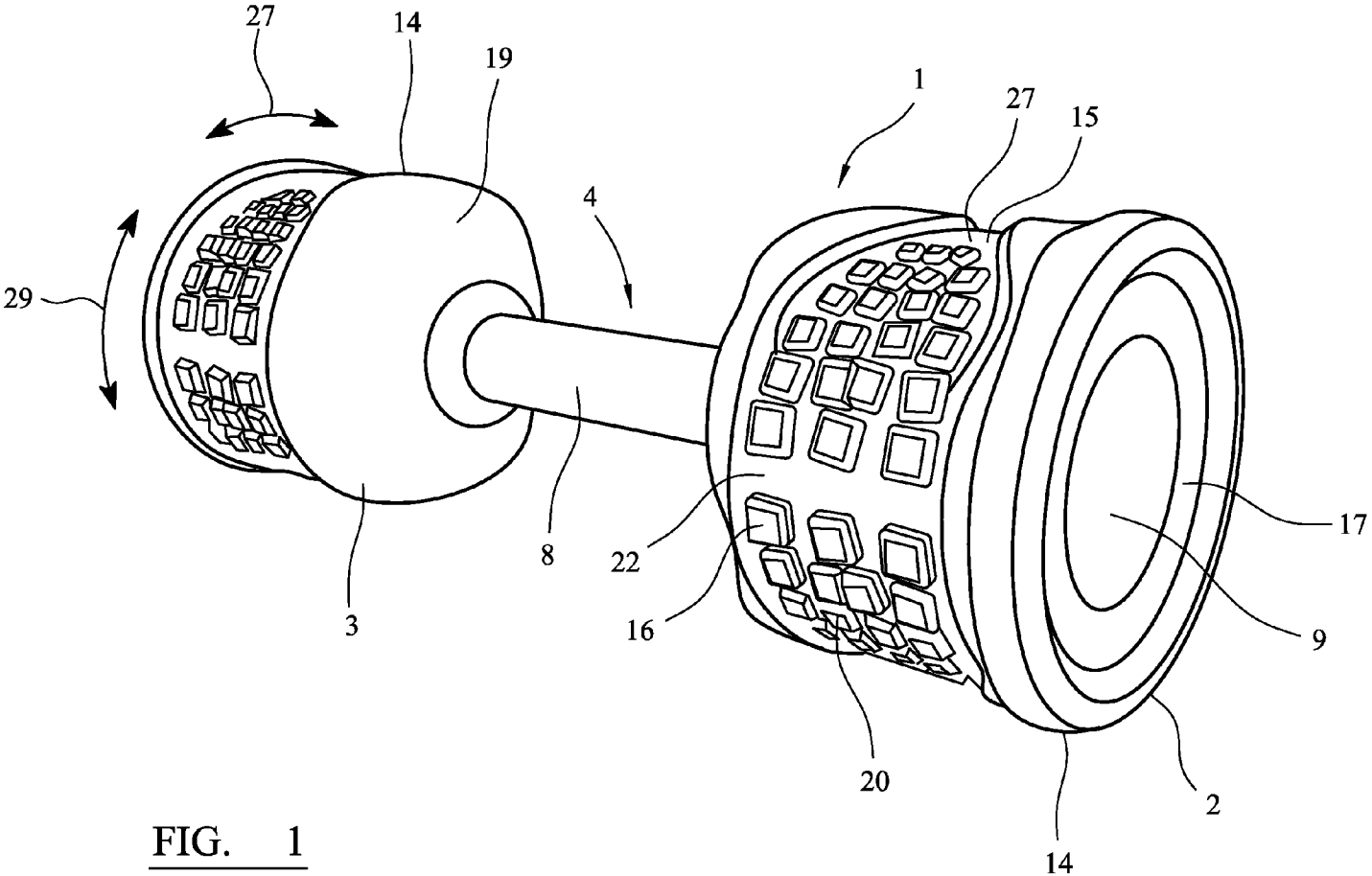
FIG. 1 is a perspective view of a dumbbell according to an embodiment of the invention.

Referring to FIG. 1, a dumbbell 1 comprises first and second weight sections 2 mounted to opposing ends of a bar 4. The bar 4 comprises a handle portion 8, configured to enable a user to grip the bar 4 to lift the weight sections 2. The bar 4 is preferably formed from stainless or carbon steel, and the handle portion 8 is provided with a knurled surface, to improve grip.

Figure 2:
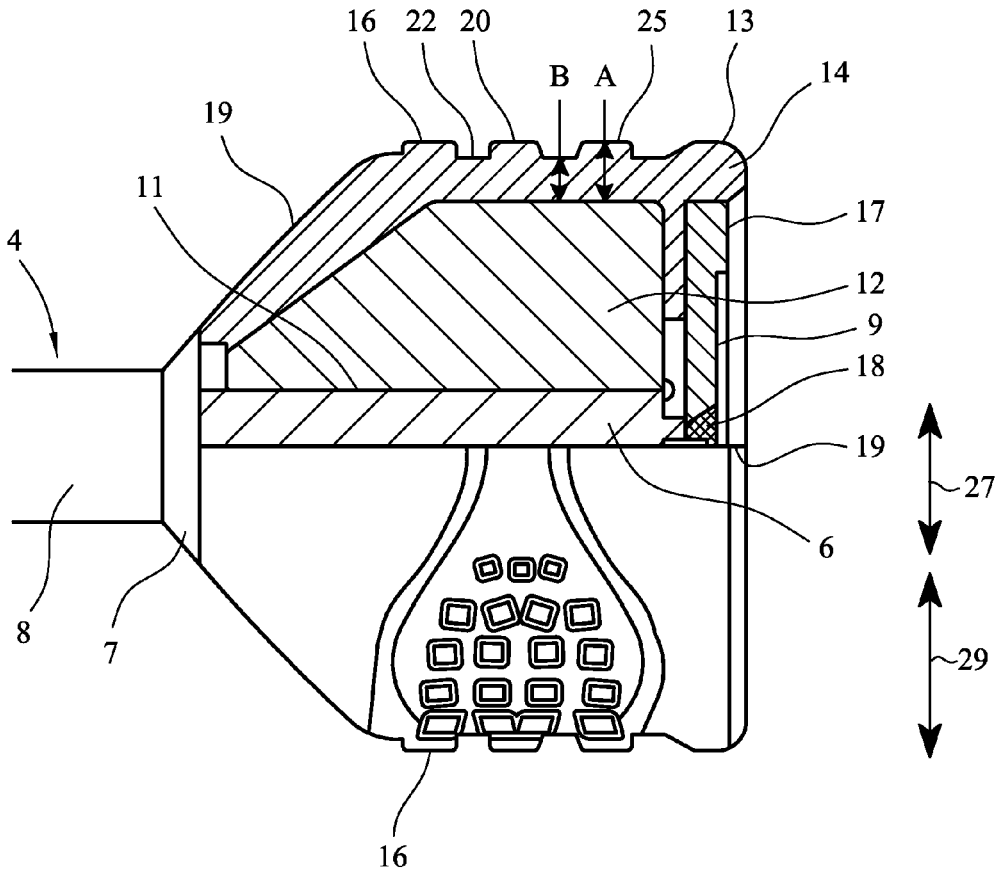
FIG. 2 is a cross sectional view of a weight section of the dumbbell of FIG. 1, showing a section taken through one half of the weight section.

The weight sections 2 have a central axis and are preferably substantially cylindrical in shape. The weight sections are preferably mounted on the ends the bar 4 coaxially with an axis of the bar. As shown in FIG. 2, the bar 4 comprises end mounting portions 6 to which the weight sections 2 are mounted. Each weight section 2 comprises an inner weight section 12, formed from cast iron, although any other suitable material may be used. An inner bore 11 is preferably formed in the inner weight section 12 during the casting processing or may be machined after casting. The inner bore 11 is configured to receive the end mounting portion 6 to mount the weight section 2 to the bar 4. The inner bore 11 is toleranced to provide an interference fit with the end portion 6, to prevent rattle between the end portion 6 and the inner weight section 12. Alternatively, the inner weight section 12 may be cast about a collar (not shown), which is subsequently internally machined to provide the required interference fit with the end portion 6.

Each weight section 2 further comprises an end plate 9. The end plate 9 is secured to the end portion 6 to secure the weight section 2 to the bar 4. Specifically, the end plate 9 co-operates with a flange 7 located inward of the end portion and defining an inner stop for the weight section to hold the weight section 2 on the bar 4. In the arrangement shown in FIG. 2, the end portion 6 of the bar 4 includes an end spigot 19 at its distal end. The end plate 9 includes a central aperture 18 configured to receive the end spigot 19. The aperture 18 is chamfered to provide a well surrounding the spigot 19, which is back filled with a weld to hold the end plate 9 on the bar 4. Alternatively the end plate 9 may be secured to the end portion 6 by a screw connection to an internal threaded bore in the end portion 6, or by any other suitable means. In these embodiments the weight section 2 is thereby permanently secured to the bar 4. It will however be appreciated that in other embodiments the weight sections 2 may be removably secured to the bar 4 to allow the weight sections to be changed and a series of interchangeable different weight sections 2 provided for different exercises and/or users.

An outer skin 14 of polyurethane or rubber material is formed about the inner weight section 12. Specifically, the outer skin 14 is molded about the inner weight section. As cast iron typically comprises a low quality surface finish, the outer skin 14 provides the weight section 2 with an improved visual appearance. In addition, the resilient and compressible material properties of the polyurethane act to protect the inner weight section 12 from damage, and to provide limited impact absorption. In addition, coating the inner weight section 12 with an outer skin 14 protects the cast iron from corrosion, and mechanical damage.

The weight sections 2 each include a circumferential surface 15 extending around the circumference of the weight section 2, and a substantially axial end surface 17, to which the end plate 9 is connected. A plurality of raised surface features or projections 16 project from the side surface 25 of the outer skin 14. Alternatively, grooves or recessed portions may be formed into the outer skin 14, with the grooves defining the projections 16 there between. The projections 16 define a relief pattern on the circumferential outer surface 15 of the outer skin 14. The projections 16 comprise regions of varying thickness across the outer skin 14. The projections 16 in particular comprise discrete individual resilient projection elements, and solid blocks of resilient material, extending from the lower surface of the outer skin 14. The projections 16 are formed from and are integral with the outer skin 14. As shown in FIG. 2, the projections 16 extend from the surface of the outer skin 14, to define raised areas 20 of the outer skin 14 having a first thickness A, and a lower surface 22 of the outer skin 14 having a second thickness B which is less than A.

Figure 3A:
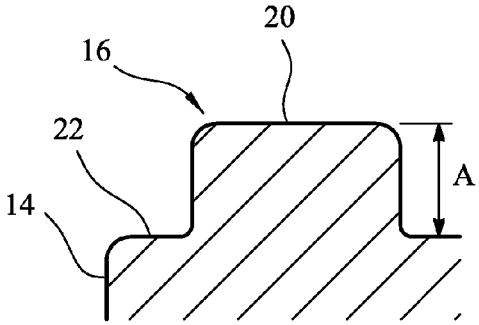
FIG. 3*a* is a cross sectional view of an uncompressed shock absorbing projection according to an embodiment of the invention.
Figure 3B:
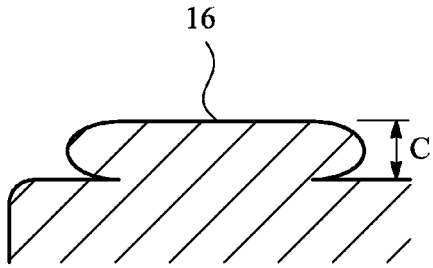
FIG. 3*b* shows the shock absorbing projection of FIG. 3*a* in a compressed state during impact.

The projections 16 are in particular formed about the circumferential surface 15 upon which in use the weight section 2 and dumbbell is usually dropped and rests upon when placed on the floor. The shape and resilient material properties of the projections 16 are such that they act as shock absorbers, to provide the dumbbell 1 with improved impact absorption properties. Specifically, when the dumbbell 1 is dropped to the floor in such a way that the outer surface 15 of the weight section 2 impacts against the ground, it is an upper end surface 20 of the shock absorbing projections 16 which impact against the floor. Since the projections 16 comprise discrete elements having lateral walls separated from each other, and having distal upper end surfaces 20, the projections 16 can deform and flex under such impact loading. FIG. 3*a* shows a projection 16 prior to impact in the uncompressed position in which the projection 16 is at its full height and thickness A. During impact the projection 16 is compressed to a reduced thickness C, as shown in FIG. 3*b*, in which the thickness of the projection 16 decreases while its width increases as it is compressed. The compression of the projection 16 absorbs a portion of the impact energy. As such, the impact of the weight section 2 on the ground is cushioned by the compression, deformation and flexing of the projections 16. In contrast a solid outer skin layer is not able to be compressed as easily under impact since the continuous surface restricts and constrains the adjacent parts of the skin and is less able to absorb such impact energy. The discrete projections 16 therefore provide improved impact energy absorption.

In particular the use of a polyurethane coating for dumbbell weight sections is advantageous as it provides significantly improved wear resistance compared to rubber. However, solid polyurethane has a lower resilience than rubber and therefore does not perform as effectively in absorbing impact when a dumbbell is dropped. It has been found that by forming the projections 16 on the outer surface of a polyurethane skin 14, it enables a polyurethane skin to function similarly to rubber due to the above described compressibility of the projections 16, while still maintaining high wear resistance.

The relief pattern formed by the projections 16 also increases the surface roughness providing the additional advantage of increasing the grip of the circumferential surface 25 of the weight section 2. This increases the functionality of the dumbbell 1 by enabling it to be more effectively and safely gripped by the weight sections 2, and therefore used to perform an increased and varied number of weight-lifting and exercise operations. In particular, grasping the dumbbell by the weight sections 2 requires an alternative grip, and therefore forces the user to lift the dumbbell 1 in a different way, using different muscle groups. The relief pattern of the projections 16 also provides increased traction between the outer surface and the floor when the dumbbell is placed on the floor, which enables a user to support their weight on the dumbbell bar 4, for example to perform push-ups, while limiting the risk of the dumbbell slipping from underneath them during use.

The projections 16 are provided only in certain discrete circumferential areas 29, and not around the entire circumference of the weight section 2. In other circumferential regions 27 there are no projections 16 and relief pattern. In particular the projections 16 are only be provided in specific circumferential regions 29 to define specific grip areas for a user to lift the dumbbell 1, and/or in the regions where the dumbbell is usually dropped or rested or where the weight section 2 and dumbbell 1 should be placed on the ground. By providing the projections only in such discrete regions 29 defines such a grip area for a use and also assist in prevent the dumbbell 1 from rolling when placed on the ground. In this case the projections 16 are defined in two discrete regions 29 on diametrically opposing circumferential sections of the weight sections. While the projections are disposed around most of the circumference there is a region 27 where there are no projections 16. The region 29 of the circumference over which the projections 16 are located also, as shown, tapers over the axial width over which it extends around the circumference, such that it has a maximum axial extend at one circumferential location reducing to a minimum and the region 29 where there are no projections 16.

The projections 16 may be located in a recessed portion of the outer skin 14, as shown in FIGS. 1 and 2, with also axial areas of the outer skin 14 without projections surrounding the areas with the projections 16. This advantageously provides some lateral protection for the projections 16 against lateral knocks which may tear the projections 16 from the outer skin 14 or otherwise damage the projections 16. In particular the outer skin 14 may include a peripheral rim projection 13 around the axial end circumference to protect the other projections 16

The projections 16 and relief pattern defined by the projections 16 on the surface of the outer skin 14 may be of any shape or pattern. In the embodiment shown in FIG. 1 the projections 16 have a square shape and the relief pattern is a random geometric pattern which extends across a large proportion of the side surface 25. Alternatively, the projections 16 and relief pattern comprise a plurality of raised dimples, or a plurality of cylindrical projections forming a bristle like surface.

The relief pattern and projections 16 may be formed by a series of parallel grooves extending around the outer surface 15, the grooves defining the raised projections 16 there between, or formed by formed by a series of angled grooves forming a diamond or cross hatched pattern of projections 16, or formed from a tread pattern of grooves similar to that of a vehicle tyre.

The outer skin 14 is preferably formed about the inner weight section 12 by a molding operation using a mold (not shown) into which the inner weight section 12 is placed with the mold surrounding the inner weight section 12. The mold defines a mold cavity between the inner weight section 12 and an inner mold surface corresponding to the outer skin 14. A material, such as polyurethane, is then injected into the mold cavity, where it forms about the inner weight section 12. In this way an outer skin 14 having the plurality of projections 16 is formed about and molded onto the inner weight section 12.

The mold may in particular comprise two mold sections, or mold halves. The two mold halves may be further fitted into an outer mold section to hold them together during molding. The mold halves each comprise an inner surface having a configuration including recesses shaped to define the projections 16. The mold halves are split along a longitudinal plane passing though the axis of the weight section 12. The mold halves can thereby be separated and the mold split open to allow the inner weight with molded outer covering with the projections 16 to be removed. This two part mold arrangement enables the mold to be easily removed from the weight section after molding by separating the two mold sections, which would not be possible with a one piece mold due to the projections 16 extending into the mold walls.

The mold halves are preferably held together by an outer sleeve that slides over the outside of the two, inner, mold halves. Thus the mold generally comprises a three part mold. After molding the outer sleeve is removed by sliding it off the inner mold halves, leaving the mold halves around the newly formed weight section 12. The inner mold halves can then be separated and the weight section removed 12.

The inner surfaces of the mold sections include a relief profile corresponding to the projections 16. This also provides the molds with a specific fingerprint corresponding to the relief pattern. As such, it is immediately evident whether dumbbells have been produced using the mold sections, whereas it is difficult to identify where a dumbbell having a smooth outer skin has been molded. This unique fingerprinting of the molds prevents unauthorized use of the molds to produce products for third parties.

While it is preferred to mold the outer skin 14 onto the inner weight section 12 and integrally form the projections 16 with the outer skin 14, it will be appreciated that the projections 16 could be formed into an outer skin 14 subsequently after the outer skin 14 has been formed. For example the projections 16 could be formed by cutting, branding or stamping grooves or recesses into the circumferential outer surface of the outer skin 14 to define the projections 16 in regions between such grooves or recesses.

In further embodiments an axial end face of the weight section may also include plurality of resilient axial end face projections (not shown) projecting from the axial end face of the weight section, preferably axially beyond the end of the bar, and having a distal end surface which defines an axially outermost end surface of the exercise device. These axial end face projections are preferably disposed and extend intermittently around the periphery of the end face and define a castellated form on the axial end face of the weight section, and preferably comprise a molded integral part of the outer skin 14. These axial end face projections protect the axial end face and in particular end plate 9 from impact. This is described in more detail in our co-pending UK patent application number GB 0911851.4 (reference P355355 GB; P11 GB/P 12 GB) entitled "Exercise Device Weight" the features of which are incorporated herein by reference.

While the exercise device 1 is described as being a dumbbell, the invention may equally apply to a barbell or similar exercise device. In addition, while the fixing means is described as being an end plate, any suitable means of securing a weight section to a bar may be utilised. Moreover while as mentioned above in this embodiment the weight sections 2 are permanently fixed to the bar 4, the weight sections 2 may be removably fixed to the bar and the invention, and in particular providing projections 16 on the outer circumferential outer surface, may be applied to removable weight sections 2 and used on for example weight discs that are interchangeably fixed to a bar 4.

The weight sections 2 in this embodiment are generally cylindrical having a circular outer circumference. In other embodiments the weight sections 2 may have other shapes while still having a generally circumferential surface and central axis. Furthermore the weight sections 2, bar 4, and handle 8 upon which the weight sections are mounted do not need to be coaxial with the central axis of the weight sections 2.

Figure 4:
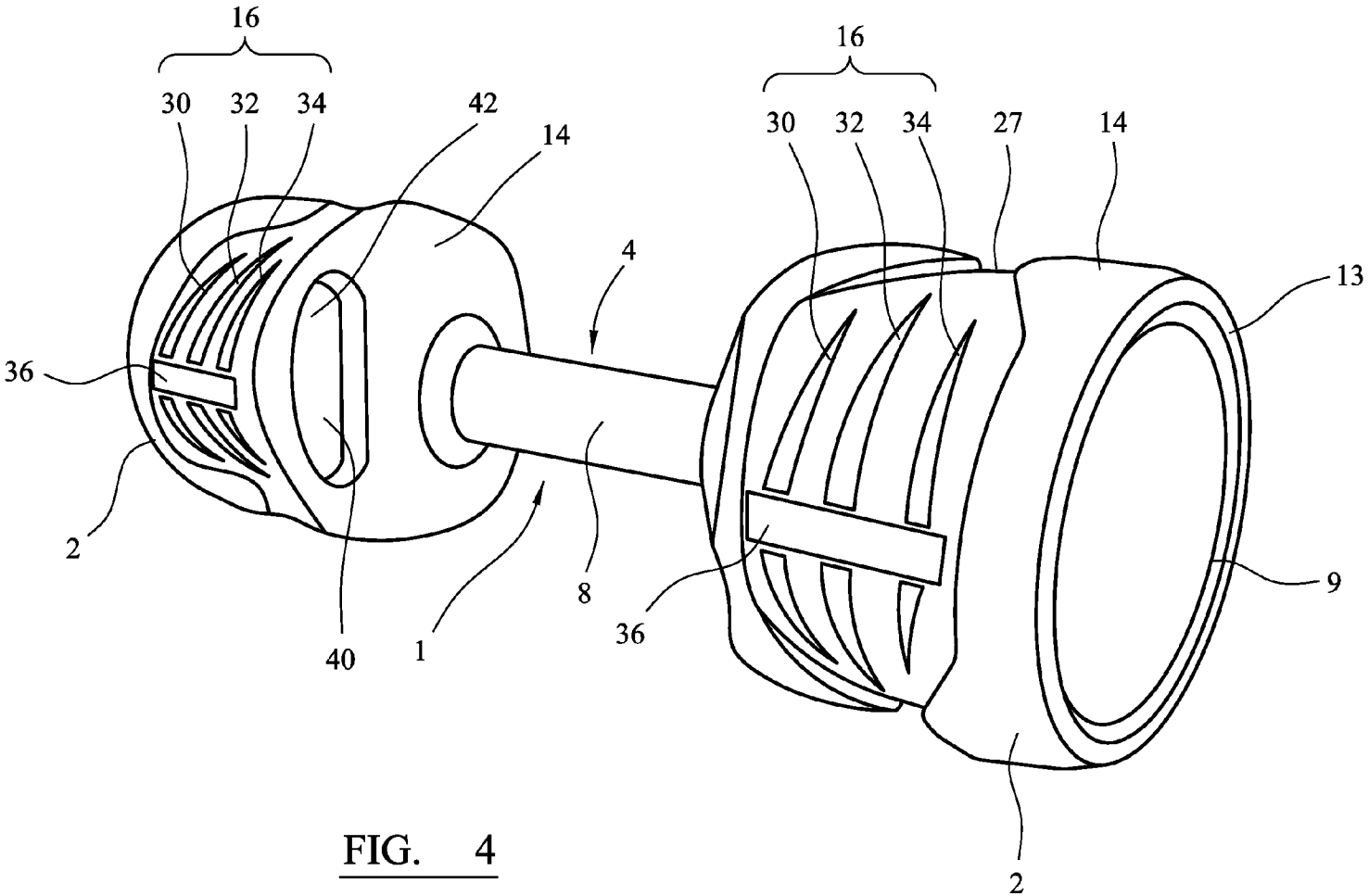
FIG. 4 is a perspective view of a dumbbell according to another embodiment of the invention.
Figure 5:
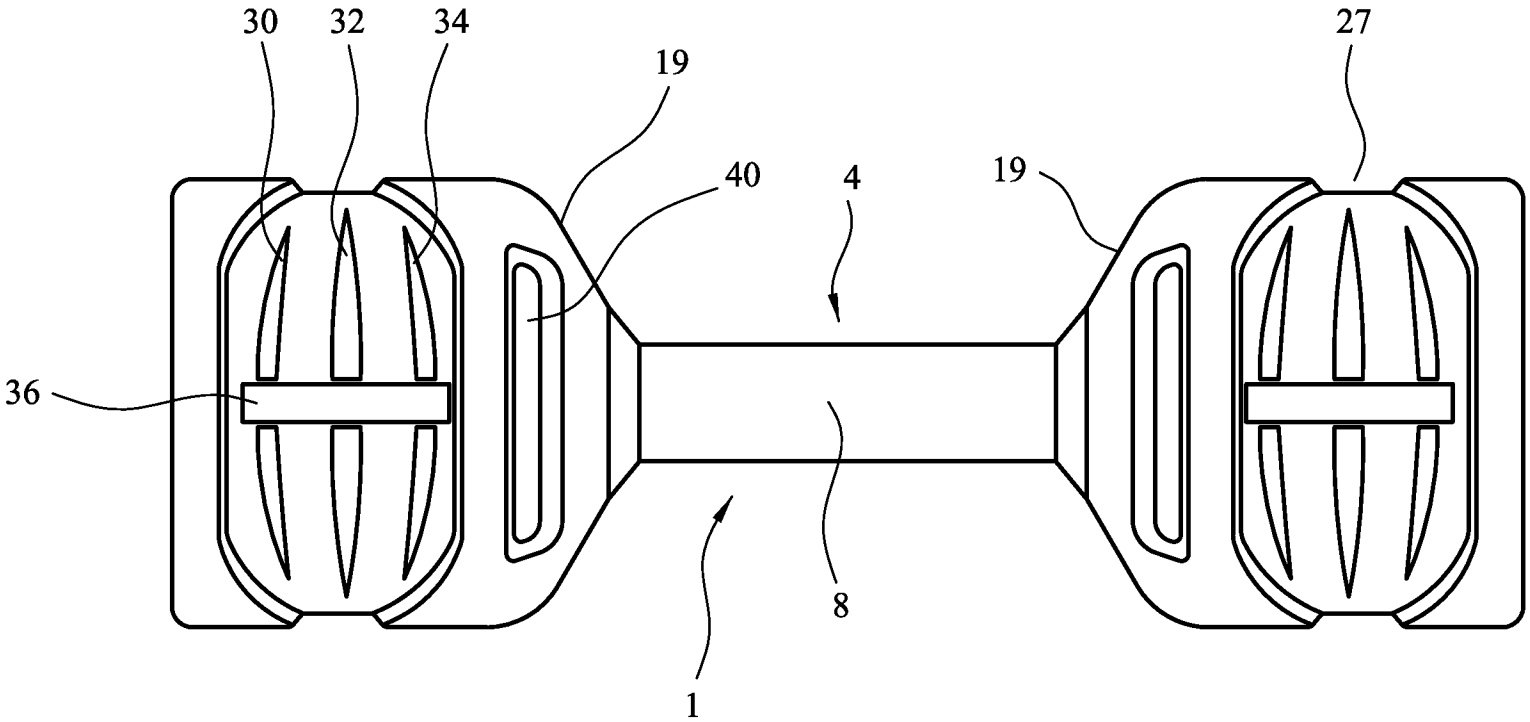
FIG. 5 is a front view of the dumbbell shown in FIG. 4.
Figure 6:
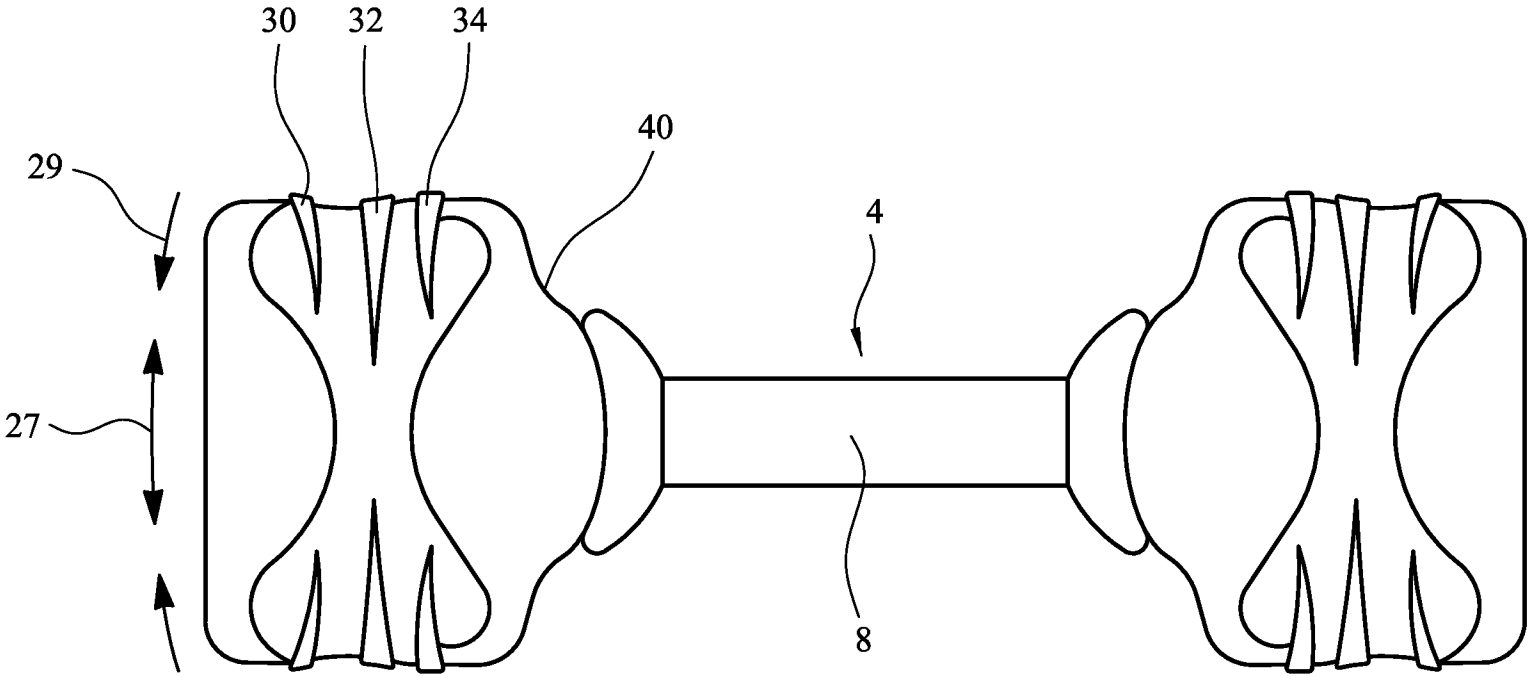
FIG. 6 is a top view of the dumbbell shown in FIG. 4.

A second embodiment of the invention is shown in FIGS. 4 to 6. In this embodiment like reference numerals are used to indicate the like features. This embodiment and dumbbell is generally similar to that described above and shown in FIGS. 1 to 3 and so only the main difference will be described in detail.

In particular in this embodiment the projections 16 now comprise a series of tapering circumferentially extending ribs 30,32,34. These comprise a longer central rib 32 and two shorter ribs 30 and 34 disposed axially either side of the central rib 32 and which do not extend circumferential as far around the weight section 2. There is also a further axially extending projection 36. Again as in the first embodiment the projections 16 are only disposed and extend over and around part 29 of the circumference of the weight section 2 and there is a region 27 where there are no projections 16 as most clearly shown in FIG. 6.

In this embodiment there is also a pair (although in other embodiments there may be only one) of recesses 40 defined in each the weight section 2, and defining an axially facing shoulder surface 42. These recesses 40 are located diametrically opposite each other on each weight section 2 and extend over and around only part of the circumference of the weight section 2. In particular the recesses are aligned with the regions 29 of circumference of the weight section 2 where the projections 16 are located. The recesses 40 are located toward and on the inner axial ends faces 19 of the weight sections 2 which when mounted on the bar 4 face each other and are adjacent the handle 8. The recess 40 are sized and dimensioned so that a user's fingers can fit within them resting against and gripping the shoulder surface 42, with the palms of a user's hands resting on the region 29 with the projections 16. This allows a user to more readily grip and hold the weight section 2 and dumbbell 1 by the weight section 2 and end. This provides an alternative way for a user to hold the dumbbell 1 rather than just using the handle 8. The recesses 40 in particular better define this alternate grip and provide a suitable handle formation for holding the weight sections and dumbbell 1 by its end and weight sections 2.

It is preferred that the recesses 40 are defined and molded entirely within the resilient outer skin 14, and that the inner weight section 12 formed from cast metal does not include such a corresponding recess. This makes casting of the inner weight section 12 easier. Alternatively however the inner weight section 12 may also include a corresponding recess portion over which the outer skin 14 is molded to collectively form the recess 40.

In both this embodiment and the earlier embodiment the inner axial faces 19 of the weight sections 2 which face each other when the weight sections 2 are mounted on the bar 4 and which are adjacent the handle 8 both have a tapering and sloped profile. The inner axial faces 19 are not perpendicular to the axis in contrast to the outer axial end faces 17 of the weight sections 2. This tapering of these inner axial end faces 19 makes it easier for a user to hold the dumbbell 1, both when holding the dumbbell 1 by the end and weight sections 2, and also more conventionally when gripping the handle 8. In particular a tapering axial inner face 19 more comfortably abuts against user's hand when gripped around the handle 8, and may also allow a shorter axial length of handle 8 to be used between the weight sections 2.

It will also be appreciated that in further embodiments, various further modifications to this specific arrangement described above and shown in drawings may be made.

What is claimed is:

1. An exercise device weight section for mounting to a lifting bar, the weight section having an outer circumferential surface and comprising an outer skin at least partially around the outer circumferential surface of the weight section; wherein the outer skin comprises a plurality of resilient projections extending from at least part of the outer circumferential surface of the weight section;

the plurality of projections are disposed only in a discrete circumferential region of the circumferential surface of the weight section, and wherein the outer skin has in interior surface secured in direct surface-to-surface contact to the circumferential surface of the weight section, the plurality of resilient projections being disposed in direct radial opposition to the interior surface portion of the outer skin in direct surface-to-surface contact with the circumferential surface of the weight section so that radially directed impact forces applied to any of the resilient projections are transferred directly through the outer skin to the weight section without radial displacement of the interior surface; and wherein a circumferential spacing is defined between adjacent resilient projections, the circumferential spacing being irregular with respect to at least some of the adjacent resilient projections;

characterized in that the outer skin includes a peripheral rim projection around an axial end circumference of the weight section which is configured to protect the projections from lateral forces, the peripheral rim projection being disposed in direct radial opposition to the interior surface portion of the outer skin in direct surface-to-surface contact with the circumferential surface of the weight section so that a radially directed impact force applied to the peripheral rim projection is transferred directly through the outer skin to the weight section without radial displacement of the interior surface.

2. An exercise device weight section of claim 1 wherein the plurality of projections define a relief pattern formed on the outer circumferential surface of the outer skin.

3. An exercise device weight section of claim 1 wherein the weight section comprises a cast metal weight.

4. An exercise device weight section of claim 1 wherein the plurality of projections are integrally formed with the outer skin.

5. An exercise device weight section of claim 1 further comprising at least one recess defined in the outer circumferential surface of the weight section.

6. An exercise device weight section of claim 5 wherein the at least one recess is formed in and as part of the outer skin.

7. An exercise device weight section of claim 5 wherein the at least one recess is aligned with the discrete circumferential region of the circumferential surface of the weight section where the projections are disposed.

8. An exercise device weight section of claim 5 wherein the at least one recess comprises a pair of recesses disposed circumferentially diametrically opposite each other.

9. An exercise device weight section of claim 5 wherein the at least one recess is defined towards one axial end of the weight section.

10. An exercise device weight section of claim 5 wherein the at least one recess and/or the discrete circumferential region are configured to form a grip portion for a user to grip and hold the weight section.

11. An exercise device weight section of claim 1 wherein the plurality of projections are disposed in a pair of diametrically opposing discrete circumferential regions of the circumferential surface of the weight section.

12. An exercise device weight section of claim 1 wherein the outer skin is formed from polyurethane or rubber.

13. The exercise device of claim 1 wherein the outer skin comprises the peripheral rim projection.

14. An exercise device comprising:

a lifting bar;

at least two weight sections, each weight section having an outer circumferential surface and comprising an outer skin at least partially around the outer circumferential surface of the weight section; the outer skin having in interior surface secured in direct surface-to-surface contact to the outer circumferential surface of the weight section, wherein the outer skin comprises a plurality of resilient projections extending from at least part of the outer circumferential surface of the weight section;

the lifting bar having two opposing end portions, and at least one weight section mounted directly to each of the opposing end portions of the bar;

wherein the at least two weight sections have each a sloped tapering axial end face, and wherein the at least two weight sections are mounted on the bar such that the sloped tapering axial end faces of the respective weight sections face each other, the weight section includes a peripheral rim projection around an axial end circumference of the weight section which is configured to protect the projections from lateral forces, the sloped tapering axial end faces of the respective weight sections being disposed in direct radial opposition to the interior surface portion of the outer skin in direct surface-to-surface contact with the circumferential surface of the weight section so that a perpendicularly directed impact force applied to either of the sloped tapering axial end faces is transferred directly through the outer skin to the weight section without radial displacement of the interior surface.

15. The exercise device of claim 14 wherein the exercise device is a dumbbell or barbell.

16. The exercise device of claim 14 wherein the outer skin comprises the peripheral rim projection.

* * * * *